United States Patent [19]

Bortz

[11] Patent Number: 4,465,055

[45] Date of Patent: Aug. 14, 1984

[54] FIREPLACE STOVE ASSEMBLY

[75] Inventor: Paul B. Bortz, North Ferrisburg, Vt.

[73] Assignee: Vermont Stove Company, Inc., Shelburne, Vt.

[21] Appl. No.: 335,590

[22] Filed: Dec. 29, 1981

[51] Int. Cl.[3] ..... F24B 5/02

[52] U.S. Cl. ..... 126/123; 126/126; 126/77; 126/121; 126/112; 126/66; 126/67

[58] Field of Search ..... 126/121, 123, 126, 103, 126/112, 67, 76, 77, 15 A, 15 R, 143, 146, 163 R, 193

[56] References Cited

U.S. PATENT DOCUMENTS

| | | | |
|---|---|---|---|
| 2,258,882 | 10/1941 | Craig | 126/121 |
| 2,433,036 | 12/1947 | Fellows | 126/76 X |
| 4,019,492 | 4/1977 | Rush | 126/121 |
| 4,026,264 | 5/1977 | Henriques | 126/121 |
| 4,129,251 | 12/1978 | Goldsby et al. | 126/121 |
| 4,141,336 | 2/1979 | Fitch | 126/121 |
| 4,184,473 | 1/1980 | McIntyre et al. | 126/77 |
| 4,214,569 | 7/1980 | Heine | 126/77 |
| 4,265,213 | 5/1981 | Gorsuch et al. | 126/66 |
| 4,350,139 | 9/1982 | Robichaud | 126/126 |
| 4,354,480 | 10/1982 | Henderson et al. | 126/123 |
| 4,361,131 | 11/1982 | Homolik | 126/123 |

*Primary Examiner*—Samuel Scott
*Assistant Examiner*—Allen J. Flanigan
*Attorney, Agent, or Firm*—Thomas N. Neiman

[57] ABSTRACT

The assembly is adapted for replaceable and operative installation within the opening of a standard fireplace. It comprises a combustion chamber and conduitry to accomodate ambient air entry into the chamber in a number of patterns and includes an arrangement for air preheating. Air is also heated by contact with the outside of the chamber and is expelled with mechanical assistance. Exhaust smoke is expelled through a baffle system in order to extract therefrom all useful heat.

11 Claims, 3 Drawing Figures

FIREPLACE STOVE ASSEMBLY

This invention pertains to fireplace stove assemblies and in particular to a fireplace stove assembly which is adapted for replaceable and operative installation within a fireplace.

The increased use of wood as a fuel for heat has resulted in an abundance of research into the efficiency of fireplaces, various standard wood stoves, and alternate devices for burning wood. Typically, a standard single direction flow stove is inserted partially into a fireplace or a series of curved pipes connected together and attached to a blower are disposed below a wood-burning grate. These devices are designed to increase the heating output of a very inefficient fireplace, but they do not wholly control air flow therethrough. It is the object of this invention to teach the use of fireplace stove assembly which will totally control the air flow through said assembly before it escapes through the chimney. Another object of this invention is to teach an assembly which provides pre-heated primary air into the combustion chamber in a downdraft motion and a secondary air input into the rear of the combustion chamber.

Also, it is the object of this invention to teach a fireplace stove assembly, for replaceable and operative installation thereof within the opening of a standard fireplace, or the like, comprising means defining a chamber in which to burn combustible products; said chamber having a grate, on which to support combustible products for combustion, and walls, rising substantially normal from, and partially circumscribing, said grate; said walls defining a substantially vertical combustion enclosure within which to accomodate rising smoke and gases; and first means for introducing ambient air downwardly relative to, and into, said enclosure, to force unburned gases, rising within said combustion enclosure, down toward said grate for combustion thereof with any combustible products in combustion on said grate.

Further objects of this invention, as well as the novel features thereof, will become more apparent by reference to the following description taken in conjunction with the accompanying figures, in which.

Figure 1:
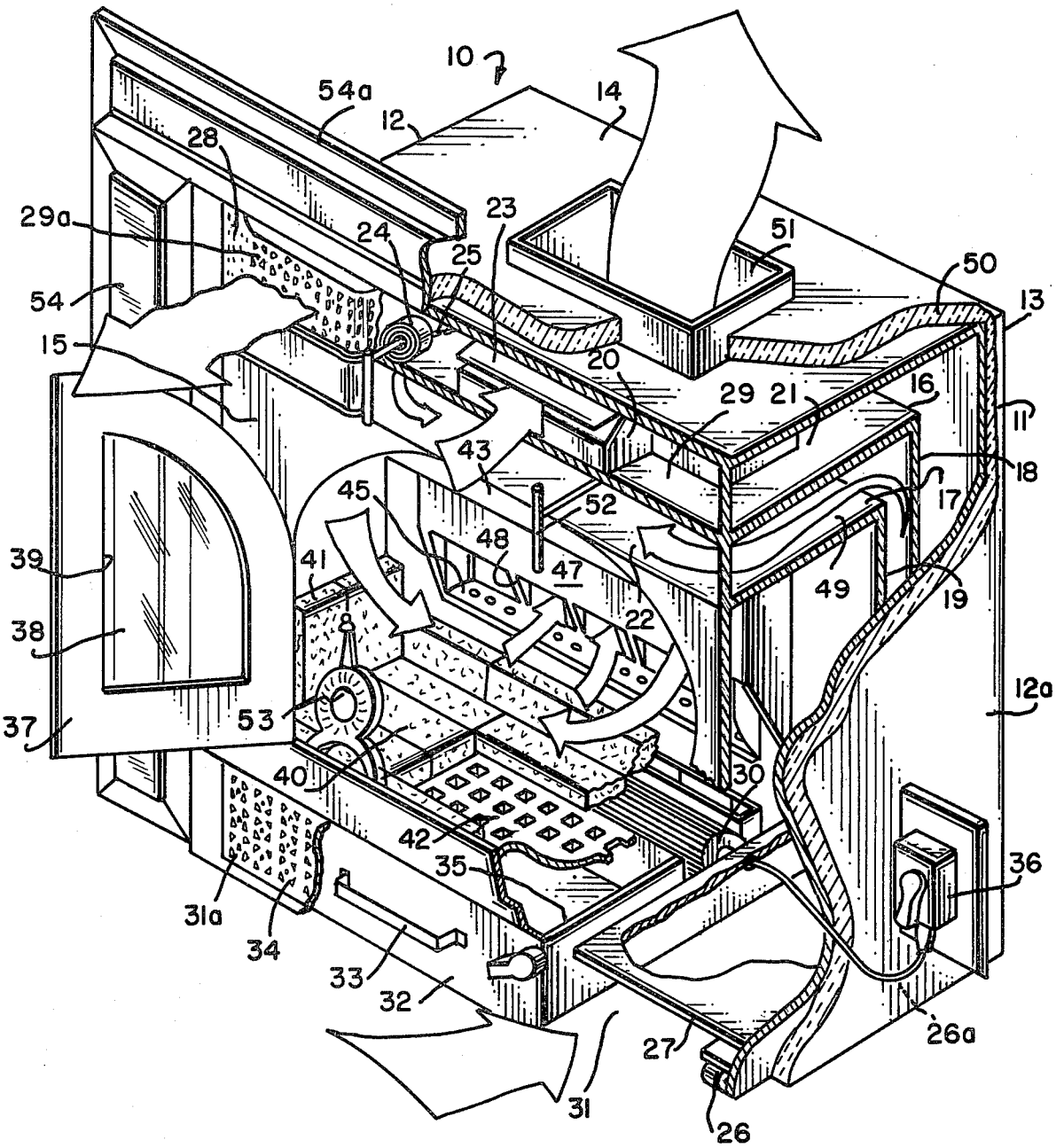
FIG. 1 is a perspective view of the novel fireplace stove assembly.

As shown in the figures, the assembly 10 comprises an outer housing 11 having sidewalls 12 and **12*a*, a rear wall 13 and a top, horizontal cover plate 14. A front panel 15 is fixed to said side walls 12 and 12*a*, and to said cover plate 14. A central housing 16 is located between said outer housing 11 and the combustion chamber housing 17. All these housings use the same front panel 15 and side walls 12 and 12*a*. The central housing 16 has a central rear wall 18 and central cover plate 21 and the combustion chamber housing 17 has a combustion chamber rear wall 19 and a combustion chamber cover plate 22. A primary air inlet 20 is a conduit located on the central cover plate 21. Said primary air inlet 20 comprises an automatic air damper 23 controlled by a thermostat 24. The thermostat 24 comprises a coiled metal band with a linkage 25 which opens and closes the damper 24 as dictated by the expansion or retraction of the metal band. The assembly 10 rides on four wheels 26 and 26*a* (only two are shown) mounted to the sidewalls 12 and 12*a* to allow for ease of positioning or cleaning. A top grill 28 (partially shown) located on the front panel 15 between the cover plate 14 and the central cover plate 21 provides a decorative opening for twin outlet ducts 29 and 29*a*. The outlet ducts allow air which is drawn in below the bottom plate 27 by a blower unit 30 to circulate through the area between the assembly housing 11 and central housing 16. The blower air inlet ducts 31 and 31*a* and ash pan door 32 and handle 33 are concealed by a bottom grill 34 which is hinged to allow for easy removal of the ash pan 35. The blower unit is controlled by a control unit 36 mounted in a nearby outlet. In practice, ambient air from the living area is drawn in through the blower air inlet ducts 31 and 31*a* and travels through the area between the assembly housing 11 and central housing 16 and is then expelled through the twin outlet ducts 29 and 29*a* into the living space. This air is being heated throughout the passage. The assembly 10 has two airtight doors 37 and 37*a* (only one is shown) which are attached to the front panel 15 of the assembly housing. Each door has a glass insert 38 which allows the fire to be seen and controlled without opening the doors. The glass inserts 38 are sealed in the door 37 with a gasket 39** to insure proper sealing.

The combustion chamber 40 has a combustion chamber housing 17 comprised of side walls 12 and **12*a*, combustion chamber cover plate 22 and a bottom plate 27. The sidewalls 12 and 12*a* are lined with firebrick 41, as is the bottom plate, with the exception of a grate 42 located in the center of the bottom plate 27 which allows ash to fall into the ash pan 35. The assembly 10 has insulation 50 on the outside of the sidewalls 12 and 12*a*, cover plate 14 and rear wall 13 of the outer housing 11**.

The combustion chamber 40 receives preheated air in two patterns. Air entering through the primary air inlet 20 enters through a conduit into the primary air intake manifold 43 which is located on the central cover plate 21 and preheats the incoming air prior to its entrance into the combustion chamber 40. The air then enters the combustion chamber 40 through the primary air inlet tube 44 (shown in FIG. 2). This tube sets up a circular air flow and introduces air downward from the top of the combustion chamber 40. The secondary air entry into the combustion chamber enters through the secondary air inlet port 45 which is located in the lower rear section of the combustion chamber 40. The air is taken from the primary air intake manifold 43 by means of a secondary air conduit 46 (shown in FIG. 2). Air passing through this conduit 46 is preheated prior to its entry to the combustion chamber 40.

After combustion takes place, exhaust smoke exits through an exhaust maniford 47 located above the secondary air inlet port 45 on the combustion chamber rear wall 19. The exhaust manifold has multiple fin units 48 which expand in the presence of heat and reflect more heat. The smoke then passes through a baffle system 49 located between the combustion chamber housing 17 and the central housing 16 enters exhaust port 57 located on the front wall of exhaust smoke chamber 51 and exits through exhaust smoke chamber 51. A T-handle 52 situated in the front panel 15 opens and closes a damper (not shown ) in the exhaust smoke chamber 51. Also shown in FIG. 1 are an andiron 53 in the combustion chamber 40 which can be used for burning with the doors 37 open and flanges 54 and **54*a* that are used to seal the assembly 10** into a sealed position in the fireplace.

Figure 2:
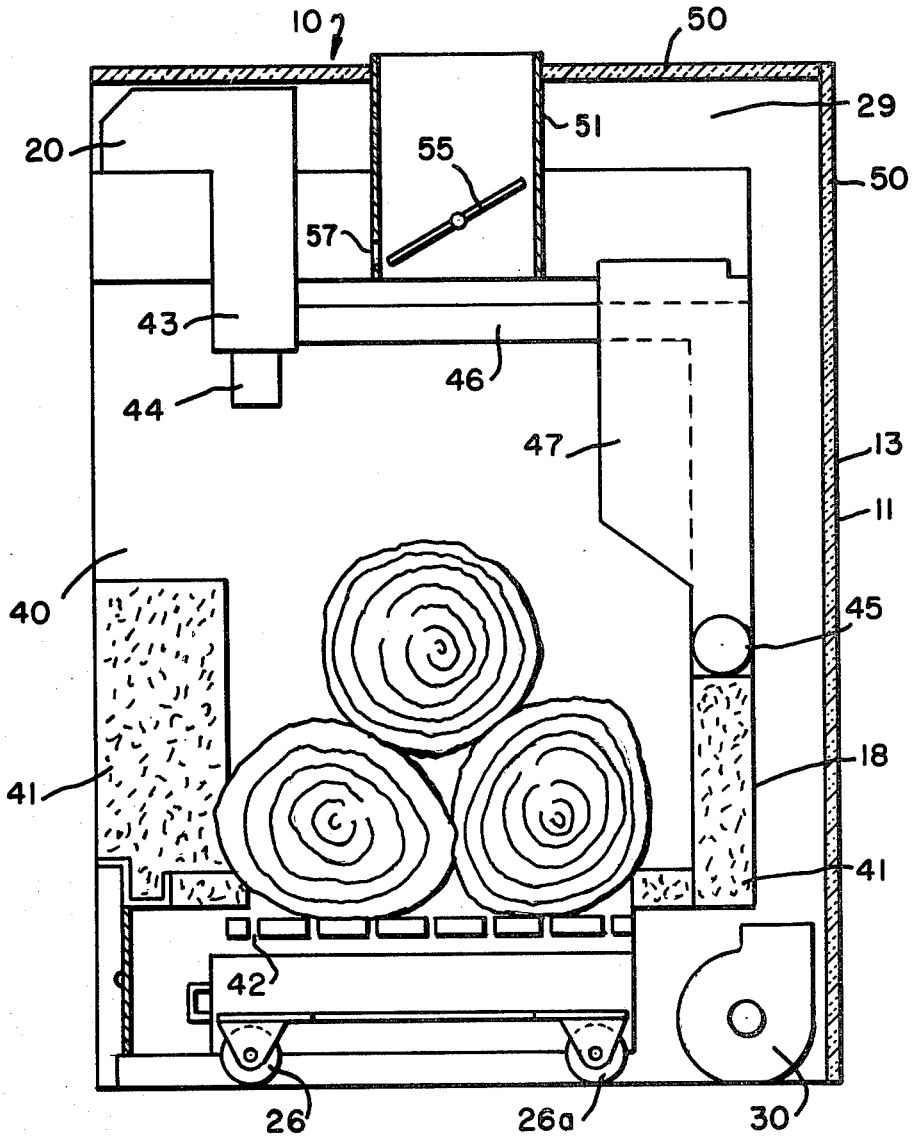
FIG. 2 is a side-elevational sectional view of said assembly.
Figure 3:
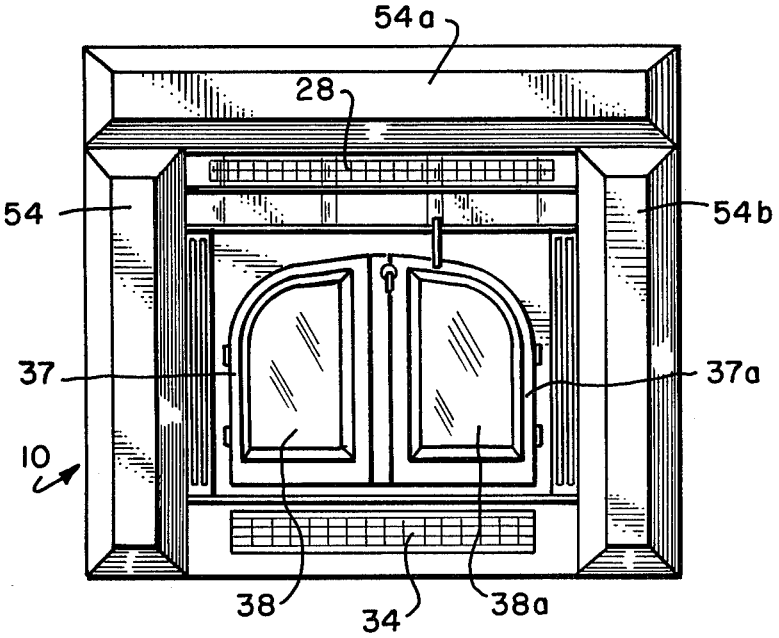
FIG. 3 is a frontal, perspective view of the novel fireplace stove assembly inserted in a fireplace.

FIG. 2 depicts the side elevational sectional view of the assembly 10. This view shows the primary air inlet 20, primary air intake manifold 43 and primary air inlet tube 44. The secondary air inlet port 45 provides a second air entry into the combustion chamber 40. This air is preheated as it passes through the secondary air conduit 46 on the way to the secondary air inlet port 45. Also shown in this view are the wheels 26 and 26*a*, blower 30, and firebrick 41, and insulation 50 on the cover plate 14 and rear wall 13 of the assembly outer housing 11. The damper 55 in the exhaust chamber 51 controls the flow of exhaust smoke. The logs rest on a grate 42 and over an ash pan 35 to permit ease of cleaning of the assembly 10. The exhaust manifold 47 is located just above the secondary air inlet port 45. The ambient air circulated by the blower 30 passes around the rear wall 18 of the combustion chamber 40 and out the outlet duct 29 into the living quarters. FIG. 3 is a frontal, perspective view of the assembly 10 which shows the unit inserted into the fireplace. The flanges 54, 54*a*, and 54*b* cover the openings between the fireplace opening and the assembly. Also shown are the top grill 28 and bottom grill 34, the doors 37 and 37*a* have glass inserts 38 and 38*a*.

In operation, the fireplace stove assembly is wheeled into place in the fireplace after the flanges are attached to seal the unit properly. The damper is adjusted and a fire is started in the combustion chamber and the doors are shut. Ambient air enters through the primary air inlet and into the combustion chamber through the primary air inlet tube and through a conduit to the secondary air inlet port. The air proceeds through the conduit to the secondary air inlet port. The air will then enter the combustion chamber for use in the combustion process and then be expelled through the exhaust manifold to the exhaust chamber. The smoke passes over and around the fin units and through the baffle system to provide maximum heating of the assembly to preheat the conduit carrying air to the secondary air inlet port and to allow more convective heating to the living area. As the assembly warms sufficiently, the blower is activated which provides heated air to the living area in addition to that which is radiating off the face of the assembly.

While I have described my invention in connection with a specific embodiment thereof, it is to be clearly understood that this is done only by way of example and not as a limitation to the scope of my invention as set forth in the objects thereof and in the appended claims.

I claim:

1. A fireplace stove assembly, for replaceable and operative installation thereof within the opening of a standard fireplace, or the like, comprising:

means defining a chamber, in which to burn combustible products;

said chamber having a grate, on which to support combustible products for combustion side walls and a rear wall rising substantially normal from, and partially circumscribing, said grate; said walls defining a substantially vertical combustion enclosure having a center portion above said grate, and a rear portion adjacent to said grate, within which to accommodate rising smoke and gasses;

first means for introducing unforced ambient air downwardly relative to, and into, said enclosure and having outlets both at said center and rear portions thereof, to force unburned gases, rising within said combustion enclosure, down toward said grate for combustion thereof with any combustible products in combustion on said grate;

said rear wall has a given length, from said grate to an uppermost portion of said enclosure; and further including conduit means for introducing ambient air into said enclosure at a location intermediate the length of said rear wall;

said first means further comprising conduit means having an opening at one end thereof which is in fluid-flow communication with said first means, and having an opening at the opposite end thereof which is exposed to said enclosure, and opens thereinto at said intermediate location to admit ambient air into said enclosure thereat.

2. A fireplace stove assembly, according to claim 1, wherein:

said conduit means comprises means cooperative with said combustion enclosure for pre-heating air which is admitted thereby into said enclosure;

said air pre-heating means comprises a conduit which traverses said enclosure above said grate to cause combustion heat to heat said conduit.

3. A fireplace stove assembly, according to claim 1, further including:

means for pre-heating air which is admitted into said enclosure by said conduit means; wherein said pre-heating means comprises a heat exchanger fixed to one of said walls;

said heat exchanger having a duct through which to exhaust combustion smoke and gases; and said conduit means comprises a conduit, a portion of the latter being in juxtaposed, heat-exchanging disposition relative to said duct.

4. A fireplace stove assembly, according to claim 3, wherein:

said duct comprises an exhaust manifold; and said manifold has a plurality of heat-absorbing and heat-radiating fins therewithin.

5. A fireplace stove assembly, according to claim 3, further including:

an exhaust chamber for smoke and gases; and means communicating said exhaust chamber and said heat exchanger, defining an exhaust channel;

said channel comprising means for causing smoke and gases to describe a baffled, serpentine path therealong.

6. A fireplace stove assembly, according to claim 5, wherein:

said enclosure has a rear defined by one of said walls, and an open front; and said channel includes means for causing smoke and gases to travel, sequentially, from said rear of said enclosure toward said front thereof, to travel across said front, and to turn toward said rear again and then rise to said exhaust chamber.

7. A fireplace stove assembly, according to claim 6, wherein:

said exhaust chamber includes damper means for controlling exhaust smoke.

8. A fireplace stove assembly, according to claim 7, wherein:

said damper means has manual control means.

9. A fireplace stove assembly, according to claim 3, further including:

means defining an air passageway which underlies said grate, rises alongside one of said walls on a side of said one wall which is opposite said combustion enclosure, and overlies said combustion enclosure.

10. A fireplace stove assembly, according to claim 9, further including:

means interposed in said air passageway for impelling air for travel thereof therealong.

11. A fireplace stove assembly, according to claim 10, further including:

said impelling means has control means for regulating the level of output of said impelling means.

* * * * *